US006053325A

United States Patent [19]

Yonker et al.

[11] Patent Number: 6,053,325

[45] Date of Patent: Apr. 25, 2000

[54] EIGHT SIDE DISPLAY BOX

[75] Inventors: Ronald Yonker, Nutley, N.J.; William Brunck, Jamestown, N.C.

[73] Assignee: The Hartz Mountain Corporation, Secaucus, N.J.

[21] Appl. No.: 09/178,186

[22] Filed: Oct. 23, 1998

Related U.S. Application Data

[60] Provisional application No. 60/063,333, Oct. 27, 1997.

[51] Int. Cl.[7] ..... B65D 5/50

[52] U.S. Cl. ..... 206/736; 206/806; 206/459.5; 206/232; 40/312

[58] Field of Search ..... 206/736, 767, 206/768, 806, 459.5, 232; 40/312

[56] References Cited

U.S. PATENT DOCUMENTS

| | | | |
|---|---|---|---|
| 3,326,361 | 6/1967 | Zimmerman | 206/768 |
| 4,413,730 | 11/1983 | Morse | 206/232 |
| 5,038,930 | 8/1991 | Holtkamp, Jr. | 206/232 |
| 5,458,235 | 10/1995 | Stone | 206/232 |
| 5,474,183 | 12/1995 | Warren et al. | 206/806 |
| 5,494,153 | 2/1996 | Housman | 206/232 |
| 5,566,831 | 10/1996 | Swenson | 206/806 |
| 5,575,384 | 11/1996 | Saye | 206/232 |
| 5,819,939 | 10/1998 | Boyer | 206/806 |

*Primary Examiner*—Paul T. Sewell
*Assistant Examiner*—J. Mohandesi
*Attorney, Agent, or Firm*—Stroock & Stroock & Lavan LLP

[57] ABSTRACT

A folding carton for a display container including a front panel, a back panel, a top panel, a bottom panel, and a flap are provided, which can yield a display box which overcomes drawbacks in the prior art. The extra flap can be hinged behind the center of gravity of the box. Preferably, the hinge is at the top of the storage portion of the box and a hanging portion of preferably double thickness with a fold preferably at the top thereof can be above the storage portion. A hole can be formed in this hanging portion. In one embodiment, the weight of the box will cause it to close the gap between the box and the extra flap when the box is hung from a hook. The extra flap can be hinged at a front side of the box. Also, offsets can be provided in the flap, so that the back of the printed box material will remain covered when the box is viewed from the front. The box is particularly useful for containing drugs. The box is advantageously formed from a single piece of material, such as cardboard or paperboard and the like.

17 Claims, 3 Drawing Sheets

EIGHT SIDE DISPLAY BOX

CROSS REFERENCE TO RELATED APPLICATIONS

This application claims priority to provisional application No. 60/063,333, filed Oct. 27, 1997 for FOLDING CARTON FOR DISPLAY BOX, the contents of which is incorporated by reference.

BACKGROUND OF THE INVENTION

This invention generally pertains to a folding carton for a box, and specifically for a folding carton for product packaging.

This type of device is commonly used for packaging a variety of products that require the display of a voluminous amount of information. The products are typically either stacked on shelving or hung on a display post of a display rack. Such products might be required by federal regulation or otherwise to inform consumers about relevant aspects of the product contained within the packaging. Recently this information has become so extensive that the information can no longer fit on the back panel of the package, while maintaining a font size considered readable.

As such, display boxes have been created that include a flap attached to the back of the box so that additional information may be printed on the flap. In that manner, manufacturers may print text upon the back of the box and upon the two surfaces of the flap. Consumers can read the text on the back of the box by lifting the flap. In addition, consumers can access additional information by lifting the flap to read the rear side of the flap and read text printed on the front side of the flap.

When consumers lift up the flap of such a prior art box, the flap often remains in an open or partially open position. As such, if the consumer returns the box to the display shelf or display post, the box occupies more room on the shelf as the confines of the box are expanded when the consumer lifts the flap. Further, because the packaging is no longer a compact, neat-looking container, the packaging losses its appeal to consumers as it appears to be used or damaged. To alleviate these problems, some packagers have taped or glued the flap to the back cover of the box. However, this solution runs counter to the very reason for providing the flap: to provided information to consumers at the time of purchase. If that information is made inaccessible to improve the appearance of the package, then it is unlikely that such a box would comply to the regulation.

Accordingly, it is desirable to provide an improved display box which overcomes drawbacks of the prior art.

SUMMARY OF THE INVENTION

Generally speaking, in accordance with the invention, a folding carton for a display container including a front panel, a back panel, a top panel, a bottom panel, a first side panel, a second side panel, and a flap are provided, which can be folded to yield a display box which overcomes drawbacks in the prior art. The extra flap can be hinged behind the center of gravity of the box. Preferably, the hinge is at the top of the storage portion of the box and a hanging portion of preferably double thickness with a fold preferably at the top thereof can be above the storage portion. A hole can be formed in this hanging portion. In one embodiment, the weight of the box will cause it to close the gap between the box and the extra flap when the box is hung from a hook. The extra flap can be hinged at a front side of the box. Also, offsets can be provided in the flap, so that the back of the printed box material will remain covered when the box is viewed from the front. The box is particularly useful for containing drugs. The box is advantageously formed from a single piece of material, such as cardboard or paperboard and the like.

Accordingly, it is desirable to provide an improved folding carton for product packaging that provides extra surface area for printing text, that overcomes inadequacies of the prior art.

Another object of the invention is to provide a display box that provides additional space to provide text, while maintaining its attractive condition.

Yet another object of the invention is to provide a display box having a flap for displaying additional text that is easy to use.

Still other objects and advantages of the invention will in part be obvious and will in part be apparent from the specification and drawings.

The invention accordingly comprises the several steps and the relation of one or more of such steps with respect to each of the others, and the product embodying features of construction, combinations of elements and arrangements of parts which are adapted to effect such steps, all as exemplified in the following detailed disclosure. The scope of the invention will be indicated in the claims.

BRIEF DESCRIPTION OF THE DRAWINGS

For a fuller understanding of the invention, reference is had to the following description, taken in connection with the accompanying drawings, in which.

DETAILED DESCRIPTION OF THE PREFERRED EMBODIMENTS

Figure 1:
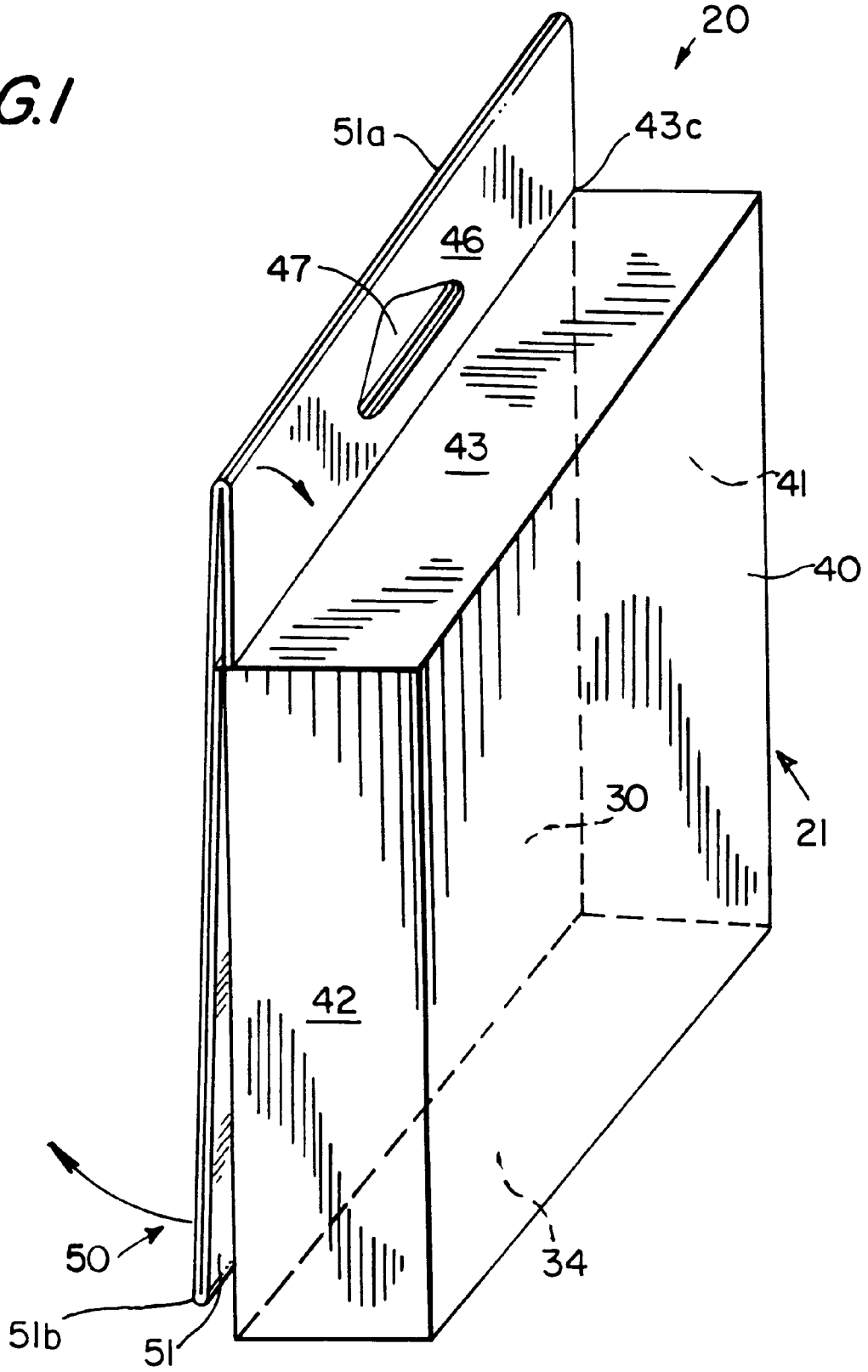
FIG. 1 is a perspective view of a display box constructed in accordance with an embodiment of the invention.
Figure 2:
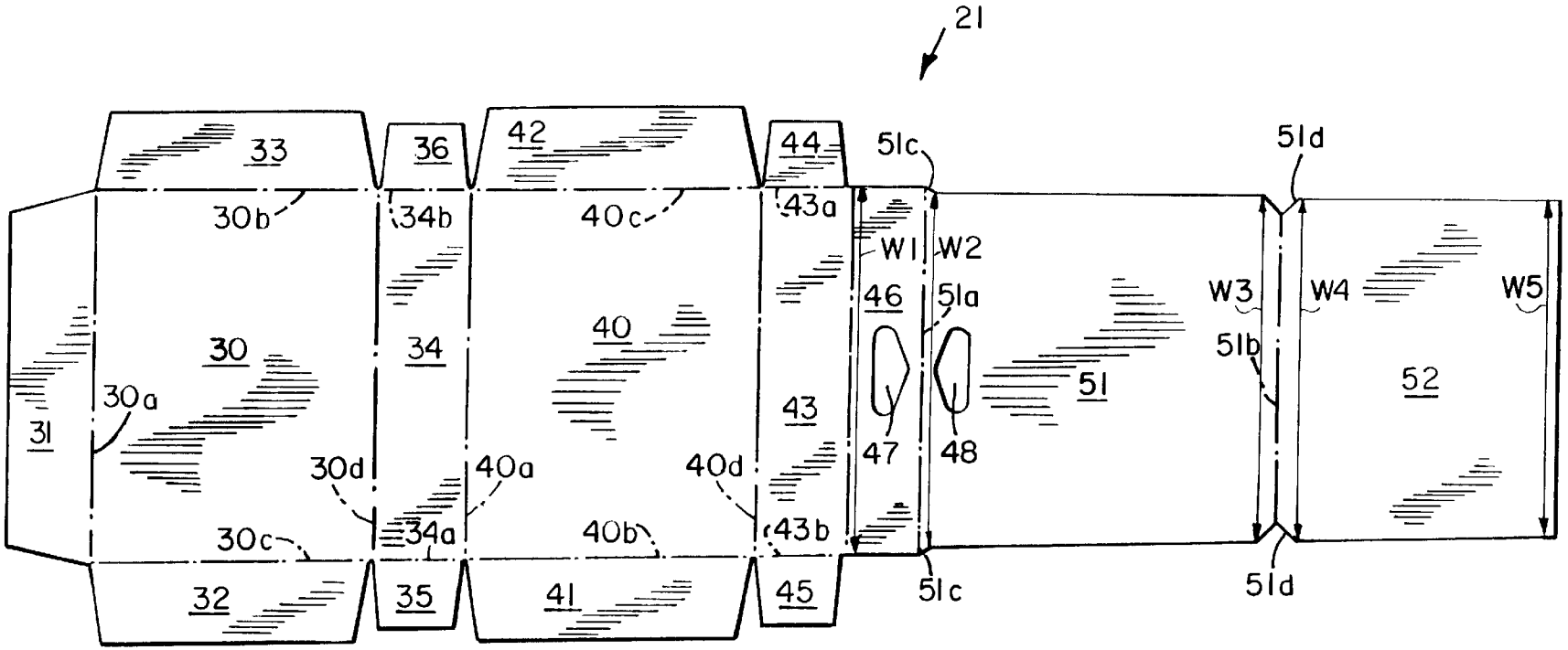
FIG. 2 is a plan view of a blank for a folding carton for a display box constructed in accordance with an embodiment of the invention.
Figure 3:
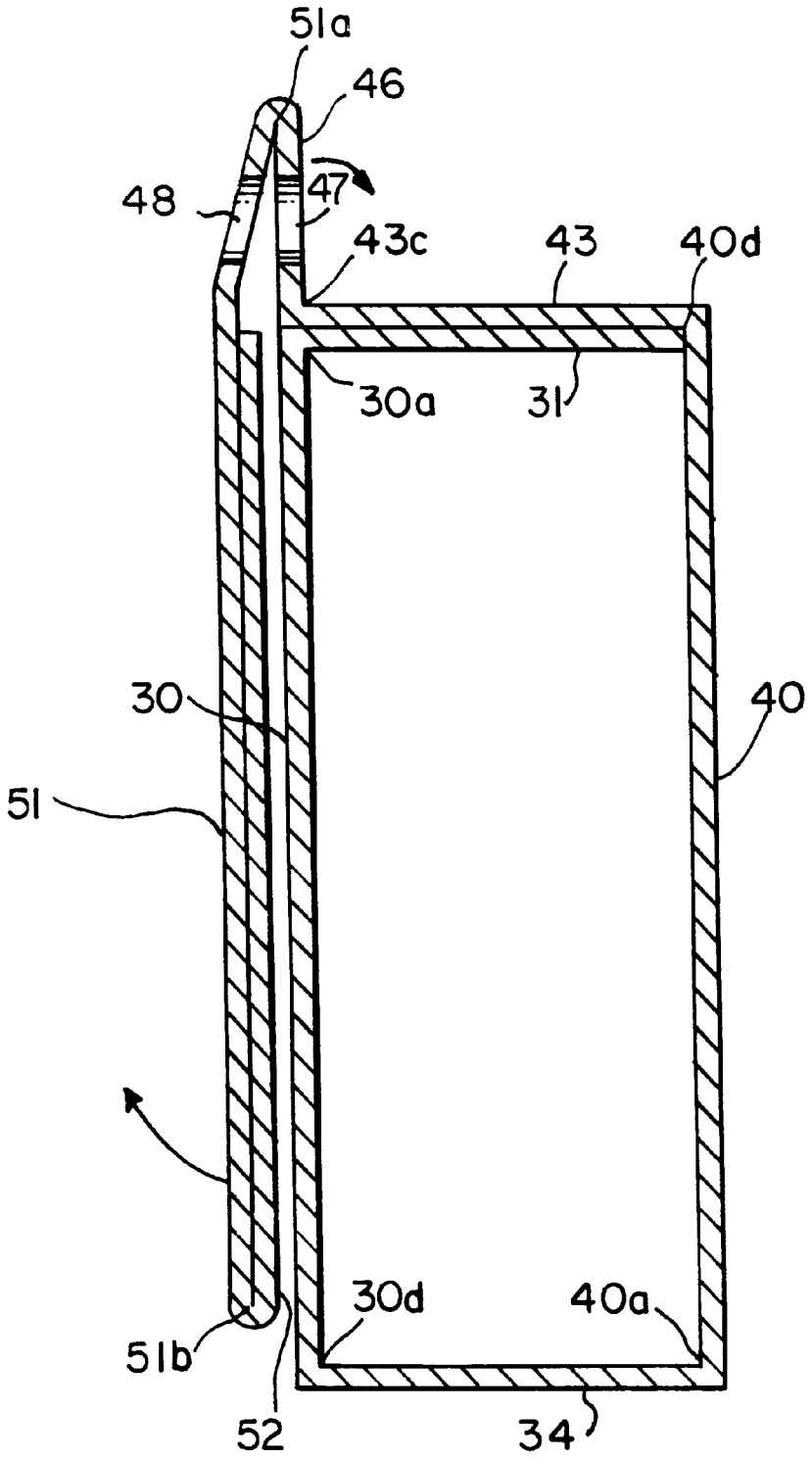
FIG. 3 is a cross-sectional view of the folding carton for a display box constructed in accordance with the invention.

Referring to FIGS. 1–3, a display box, indicated generally as 20, is depicted as constructed in accordance with a first embodiment of the invention. The display box is formed with metalized solid bleached sulfate (SBS) paperboard, having a thickness of 0.016". The paperboard should have a coating that is preferably scuff- and alcohol-resistant, and preferably should withstand 100 cycles under a four pound weight on a Sutherland Tester. While display box 20 is described as being formed out of a paperboard laminate material, it would be possible to construct this structure out of any number of materials, such as cardboard, plastic or other box forming materials.

Foldable boxes are preferably formed as a flat blank, provided with a number of score lines that allow the side walls, end walls and interlocking portions of the box to be formed by folding. The scores are preferably prebroken 150° minimum. As used herein, the term score line encompasses any line provided on a paperboard blank for allowing the same to be folded in a predetermined fashion. Thus, score line encompasses, but is not limited to a preformed fold line which is free from perforations, partially perforated, or fully perforated. Providing perforations along a fold line can facilitate folding certain portions of the blank.

As is shown in FIG. 2, a blank 21 of display box 20 is shown for forming a hexagonal box. Blank 21 is scored to define a rear wall 30, a front wall 40, a top wall 43, a bottom wall 34, and first and second side walls 41 and 42 for defining a box portion. Blank 21 is further scored to define a back flap 51, a front flap 52 and an upright 46. Together with the box portion, back flap 51, front flap 52 and upright 46 define display box 20, which is shown in perspective in FIG. 1. Further score lines are provided for folding in the comers of the box for reinforcement. The blank is designed to be folded for enclosing a product requiring extensive product information, such as a flea collar or drug containing product or drugs themselves.

Blank 21 is scored so that rear wall 30 is hingedly coupled to a top lip 31, a first ear 32, a second ear 33, and bottom wall 34, along score line 30*a*, 30*b*, 30*c* and 30*d*, respectively. Bottom wall 34 is hingedly coupled to a first tab 35, a second tab 36, and front wall 40, along score line 34*a*, 34*b* and 40*a*, respectively. Front wall 40 is hingedly coupled to a first side wall 41, a second side wall 42, and top wall 43, along score line 40*b*, 40*c* and 40*d*, respectively. Top wall 43 is hingedly coupled to a third tab 45, a fourth tab 44, and upright 46, along score lines 43*a*, 43*b* and 43*c*. Upright 46 is hingedly coupled to back flap 51 along score line 51*a*. Finally, back flap 51 is hingedly coupled to front flap 52 along score line 51*b*.

When box portion 21 is folded, as shown in FIG. 1, tabs 35 and 45, and tabs 36 and 44 are disposed adjacent to and on the inside of first ear 32 and second ear 33, respectively. In turn, first ear 32 and second ear 33 are disposed adjacent to and on the inside of side walls 41 and 42. Finally, top lip 31 is disposed adjacent to and on the inside of top wall 43. Tabs 35, 36, 44 and 45, first ear 32, second ear 33, and top lip 31 are folded into box portion 21 to provide support and maintain display box 20 in square. The various tabs, ears and lips are attached to each other by a means well known in the art, such as glue.

The dimensions of one non-limiting example of box portion 21 are 3 9/16"×3/4"×4 3/8"±1/64". A second example of dimensions of box portion 21 are 3 9/16"×1 1/8"×4 3/8"±1/64". A cross-sectional view of display box 20 is shown in FIG. 3 to disclose the manner in which the different components are folded to form display box 20.

A flap portion 50 is formed when the rear side of front flap 52 is attached to the rear side of back flap 51. Top wall 43 is hingedly coupled as a living hinge to upright 46, and assumes an upright position when upright 46 is attached to the rear side of back flap 51. Preferably upright 46 and back flap 51 include cutouts 47 and 48, respectively, which are mirror images of each other and located equidistant from score 51*a*. When upright 46 and back flap 51 are attached, cutouts 47 and 48 are aligned to provide a hole which may be used to hang display box 20 on the display post of a display rack.

Preferably, back flap 51 includes offsets 51c which represent a narrowing of width W1 of back flap 51 at score 51*a* as compared to width W2 of upright 46.

Preferably, offsets 51*c* measure 1/32". The width of back flap 51 narrows slightly as measured from score 51*a* to score 51*b*, thus width W2 is greater than width W3. This taper continues in front flap 52, where width W3 of back flap 51 is greater than width W4 of front flap 52, which in turn is greater than width W5. In this manner, when display box 20 is assembled, flap portion 50 is not visible when display box 20 is viewed from front wall 40. Further, when display box 20 is viewed from the rear, looking at the front side of back flap 51 and rear wall 30, the back side of front flap 52 is not visible.

The foregoing construction creates a clean, neat looking package, especially when the front (visible) sides of the walls are coated and colored. Further, back and front flaps 51 and 52 preferably include cutaways 51*d*, which permit consumers to more easily lift up flap portion 50 to read text printed upon either the front sides of back flap 51 or front flap 52. After the text is read, the box will readily assume its original shape and not assume a "used" appearance.

When display box 20 is assembled, at the position where upright 46 is hingedly connected to top wall 43, score 43*c* permits upright 46 and flap portion 50 to pivot about score 43*c* only in a direction toward top wall 43. Because flap portion 50 is attached to upright 46, and back flap 51 is not scored at a distance equal to the distance from score 43*c* to score 51*a*, upright 46 is not permitted to pivot toward back flap 51. In this manner, upright 46 is maintained in a substantially upright position, and flap portion 50 is maintained in alignment with upright 46 also in a substantially upright position.

As a result, when a consumer lifts flap portion 50 to read text on back flap 51 or rear wall 30, by applying force to cutaway 51*d*, and thereafter releases cutaway 51*d*, flap portion 50 returns to a substantially upright position in part due to the weight of flap portion 50 as compared with the weight of upright 46 and in part due to compression forces generated in the living hinge at score line 43*c*. Also, the hinge is behind the center of gravity of the box. The difference in weight causes flap portion 50 to pivot about score 43*c* to return to a substantially upright position, and hug rear wall 30. Thus, display box 20 retains its compact, neat configuration even if consumers read the text on rear wall 30 or back flap 51. As such, whether display box 20 is placed on a shelf or hung from a display post, it does not lose its consumer appeal, and will not require extra display space. Most importantly, federal regulations may be complied without sacrificing the appearance of the packaging.

It will thus be seen that the objects set forth above, among those made apparent from the preceding description, are efficiently attained and, since certain changes may be made in the above methods and constructions without departing from the spirit and scope of the invention, it is intended that all matter contained in the above-description or shown in the accompanying drawings be interpreted as illustrative and not in a limiting sense.

What is claimed is:

1. A display box comprising:

a container portion having at least a front panel and a back panel positioned rearwards of the front panel and a two sided display panel coupled to the box portion;

the front panel having a top edge, a pair of front panel side edges extending down from the front panel top edge and a front panel bottom edge below the front panel top edge and between the two front panel side edges;

a top panel having a top panel rear edge and a top panel front edge at least partially co-extensive with the front panel top edge, the top panel extending rearwardly from the front panel top edge to the top panel rear edge;

the display panel having a display panel front section extending upwardly from the top panel rear edge to a display panel top edge and a display panel rear section extending downwards and rearwards from the display panel front section to a display panel bottom edge; and the display panel being hingedly coupled to the top panel rear edge at the junction of the top panel and the display panel in a manner for the display panel to hang against the rear panel when the display box is in an undeformed condition, to be able to swing away from the back panel into a deformed condition and then return to the undeformed condition, whereby a person can pick up the display box, swing the display panel away from the rear panel, read any material which may be written thereon and when released, the display panel will swing back to the rear panel.

2. The display box of claim 1, wherein the box is formed of a single sheet of folded material.

3. The display box of claim 1, including an inner display panel which extends upwards and forwards from the bottom edge of the display panel and is fixed to the display panel rear section and positioned between the display panel rear section and the rear panel.

4. The display box of claim 3, wherein the inner display panel is more narrow than the display panel rear section whereby it is not visible when the box is viewed from the rear.

5. The display box of claim 1, wherein an opening is formed through the display panel front section and adjacent portions of the display panel rear section to form a feature which can receive a structure for hanging the display box.

6. The display box of claim 1, wherein the display panel front section is fixed to the display panel rear section.

7. The display box of claim 1, wherein information is displayed on the front panel, rear panel and display panel.

8. The display box of claim 3, wherein information is displayed on the front panel, rear panel and two sides of the display panel.

9. A display box, comprising:

a box portion constructed to store goods, the box having a top panel and a rear panel joined to the top panel at a rear edge of the top panel and extending down from the top panel; and a display panel having a top portion and a bottom portion hingedly coupled to the rear edge, the top portion extending upwards from the rear edge, the bottom portion extending down from the rear edge and the top portion having a structural feature so that the box can be hung from a hook and the box portion and display panel are constructed and joined so that the bottom portion of the display panel can be pivoted away from the rear panel, but when the box is hung by the top portion of the display panel, the bottom portion will be positioned at the rear panel.

10. The display box of claim 9, wherein the display panel is constructed and joined to the box portion so that when the panel is pivoted away from the box portion, the top portion is pivoted towards the top panel of the box portion.

11. The display box of claim 9, wherein the top portion and top panel of the box are formed of a single sheet of material defining a living hinge at the hinged coupling of the box and display panel, the box portion, panel and hinge constructed such that when the panel is swung away from the box, compression forces are generated in the living hinge and these forces act to urge the panel to a position back towards the box.

12. The display box of claim 1, wherein the entire box portion and display panel are formed of a single sheet of material.

13. The display box of claim 12, wherein eight panels are provided which display information thereon.

14. A blank for forming a box having a top, bottom, front, back and two sides and a display flap joined thereto, comprising:

a top lip panel having an upper and a lower surface and left and right sides;

a rear wall panel joined to the right side of the top lip panel at an upwardly folding score line;

a bottom wall panel joined to the right side of the rear wall panel at an upwardly folding score line;

a front wall panel joined to the right side of the bottom wall panel at an upwardly folding score line;

a top wall panel joined to the right side of the front wall with an upwardly folding score line;

an upright panel joined to the right side of the top wall with a downwardly folding score line;

a back flap panel joined to the right side of the upright panel within an upwardly folding score line;

a front flap panel joined to the right side of the back flap panel with an upwardly folding score line; and each of said fold lines being substantially parallel with each other and the panels and score lines constructed and arranged to provide a box having eight panels for displaying information, whereby after the blank is folded into a box, a person can pick up the box, swing a display panel formed from the back flap and front flap away from the rear panel, read any material which may be written thereon and when released, the display panel will swing back against the box.

15. The blank of claim 14, wherein the rear wall panel and front wall panel have approximately the same dimensions.

16. The blank of claim 15, wherein the rear wall panel and back flap panel have approximately the same dimensions.

17. The blank of claim 16, wherein the front flap panel and back flap panel have approximately the same dimensions.

* * * * *